US011581646B2

(12) United States Patent
Tai

(10) Patent No.: US 11,581,646 B2
(45) Date of Patent: Feb. 14, 2023

(54) DIPOLE ANTENNA

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Lung-Sheng Tai, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 23 days.

(21) Appl. No.: 17/381,450

(22) Filed: Jul. 21, 2021

(65) Prior Publication Data

US 2022/0029292 A1 Jan. 27, 2022

(30) Foreign Application Priority Data

Jul. 21, 2020 (CN) ..... 202010702457.2

(51) Int. Cl.

| | |
|---|---|
| ***H01Q 5/30*** | (2015.01) |
| ***H01Q 1/24*** | (2006.01) |
| ***H01Q 5/357*** | (2015.01) |
| ***H01Q 1/42*** | (2006.01) |
| ***H01Q 5/307*** | (2015.01) |

(Continued)

(52) U.S. Cl.

CPC ..... *H01Q 5/357* (2015.01); *H01Q 1/243* (2013.01); *H01Q 1/42* (2013.01); *H01Q 5/307* (2015.01); *H01Q 5/385* (2015.01); *H01Q 1/2291* (2013.01)

(58) Field of Classification Search

CPC ..... H01Q 5/357; H01Q 1/2291; H01Q 1/42; H01Q 9/285; H01Q 5/371; H01Q 1/36; H01Q 5/20; H01Q 5/307; H01Q 5/364

See application file for complete search history.

(56) References Cited

U.S. PATENT DOCUMENTS 6,909,403 B2 * 6/2005 Wang ..... H01Q 9/40 343/702
7,095,382 B2 * 8/2006 Surducan ..... H01Q 5/378 343/793

(Continued)

FOREIGN PATENT DOCUMENTS

| | | |
|---|---|---|
| CN | 203983454 U | 12/2014 |
| CN | 303275795 S | 7/2015 |
| CN | 110676575 A | 1/2020 |

*Primary Examiner* — Vibol Tan
(74) *Attorney, Agent, or Firm* — Ming Chieh Chang

(57) ABSTRACT

A dipole antenna includes an elongate substrate and a first, second, and third conductive pieces on the substrate, the first conductive piece having a main part, a straight part, and a bent part, a free end of the straight part defining a feeding point, the second conductive piece having a bent portion, two U-shaped portions, and a ground portion, wherein the main part of the first conductive piece includes a connecting portion connected to the straight part, a meander portion connected at one end thereof to the connecting portion, and an end portion connected to an opposite end of the meander portion, and the straight part of the first conductive piece is disposed between the two U-shaped portions of the second conductive piece.

4 Claims, 5 Drawing Sheets

(51) Int. Cl.
*H01Q 5/385* (2015.01)
*H01Q 1/22* (2006.01)

(56) References Cited

U.S. PATENT DOCUMENTS

| | | | | |
|---|---|---|---|---|
| 7,605,766 | B2 * | 10/2009 | Dahlstrom | H01Q 1/36 343/702 |
| 8,552,918 | B2 * | 10/2013 | Lee | H01Q 5/321 343/702 |
| 9,093,748 | B2 * | 7/2015 | Guan | H01Q 9/26 |
| 10,141,645 | B2 * | 11/2018 | Mu | H01Q 1/38 |
| 10,965,005 | B2 * | 3/2021 | Huang | H01Q 1/2291 |
| 2005/0035919 | A1 | 2/2005 | Yang et al. | |
| 2006/0022888 | A1 | 2/2006 | Cheng | |
| 2008/0106481 | A1 | 5/2008 | Lin et al. | |
| 2012/0169560 | A1 | 7/2012 | Lee et al. | |
| 2012/0176289 | A1 | 7/2012 | Lee | |
| 2014/0132468 | A1 | 5/2014 | Kim et al. | |
| 2014/0340261 | A1 | 11/2014 | Mechaik | |
| 2016/0172764 | A1 | 6/2016 | Lin et al. | |
| 2021/0119339 | A1 | 4/2021 | Smith, Jr. et al. | |

* cited by examiner

DIPOLE ANTENNA

BACKGROUND OF THE INVENTION

1. Field of the Invention

The present invention relates to a dipole antenna comprising an elongate substrate and a first and conductive pieces on the substrate, wherein the first conductive piece includes a part cooperating with a corresponding part of the second conductive piece for controlling a current resonant path in a 5 GHz frequency band and another part cooperating with another corresponding part of the second conductive piece for controlling a current resonant path in a 2.4 GHz frequency band to achieve a good antenna efficiency for a small size antenna.

2. Description of Related Arts

With the evolving technology in wireless communications, the modern electronic products are able to communicate wirelessly through the Wi-Fi technology. A wireless communication device or system transmits and receives wireless waves via an antenna to deliver or exchange wireless signals as well as to access wireless networks. The communication system of a wireless local network is in generally divided into a plurality of frequency bands and therefore an antenna complying with operation of multiple frequency bands becomes more demanded. Besides, the trend of the antenna dimensions is getting smaller in order to adapt to smaller dimensions of electronic products.

SUMMARY OF THE INVENTION

A dipole antenna comprises: an elongate substrate; a first conductive piece on the substrate, the first conductive piece including a main part, a straight part extending from one end of the main part along a lengthwise direction of the elongate substrate, and a bent part extending from and located at a lateral side of the main part, a free end of the straight part defining a feeding point, the main part being adapted for controlling a current resonant path in a 5 GHz frequency band while the bent part being adapted for controlling a current resonant path in a 2.4 GHz frequency band; a second conductive piece on the substrate and separated from the first conductive piece, the second conductive piece including a bent portion, two U-shaped portions, and a ground portion connected between the bent portion and the two U-shaped portions; and a third conductive piece on the substrate and separated from the first conductive piece and the second conductive piece; wherein the main part of the first conductive piece includes a connecting portion connected to the straight part, a meander portion connected at one end thereof to the connecting portion, and an end portion connected to an opposite end of the meander portion; and the straight part of the first conductive piece is disposed between the two U-shaped portions of the second conductive piece.

DETAILED DESCRIPTION OF THE PREFERRED EMBODIMENTS

Figure 1:
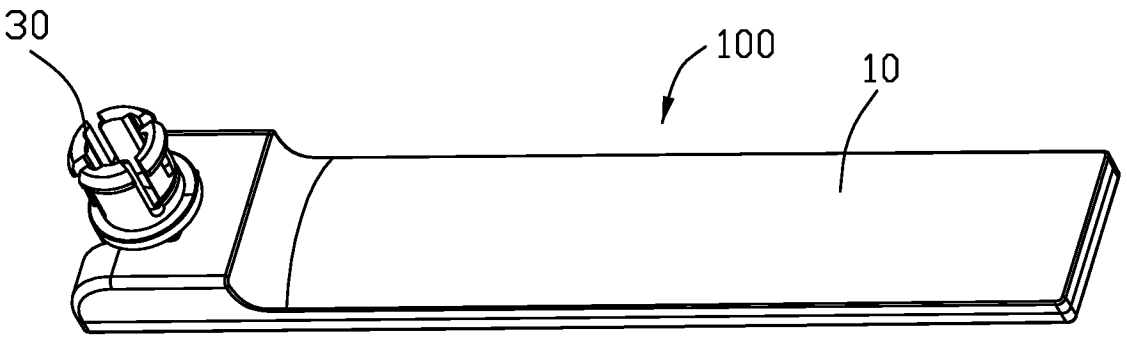
FIG. 1 is a perspective view of an antenna module in accordance with the present invention.
Figure 2:
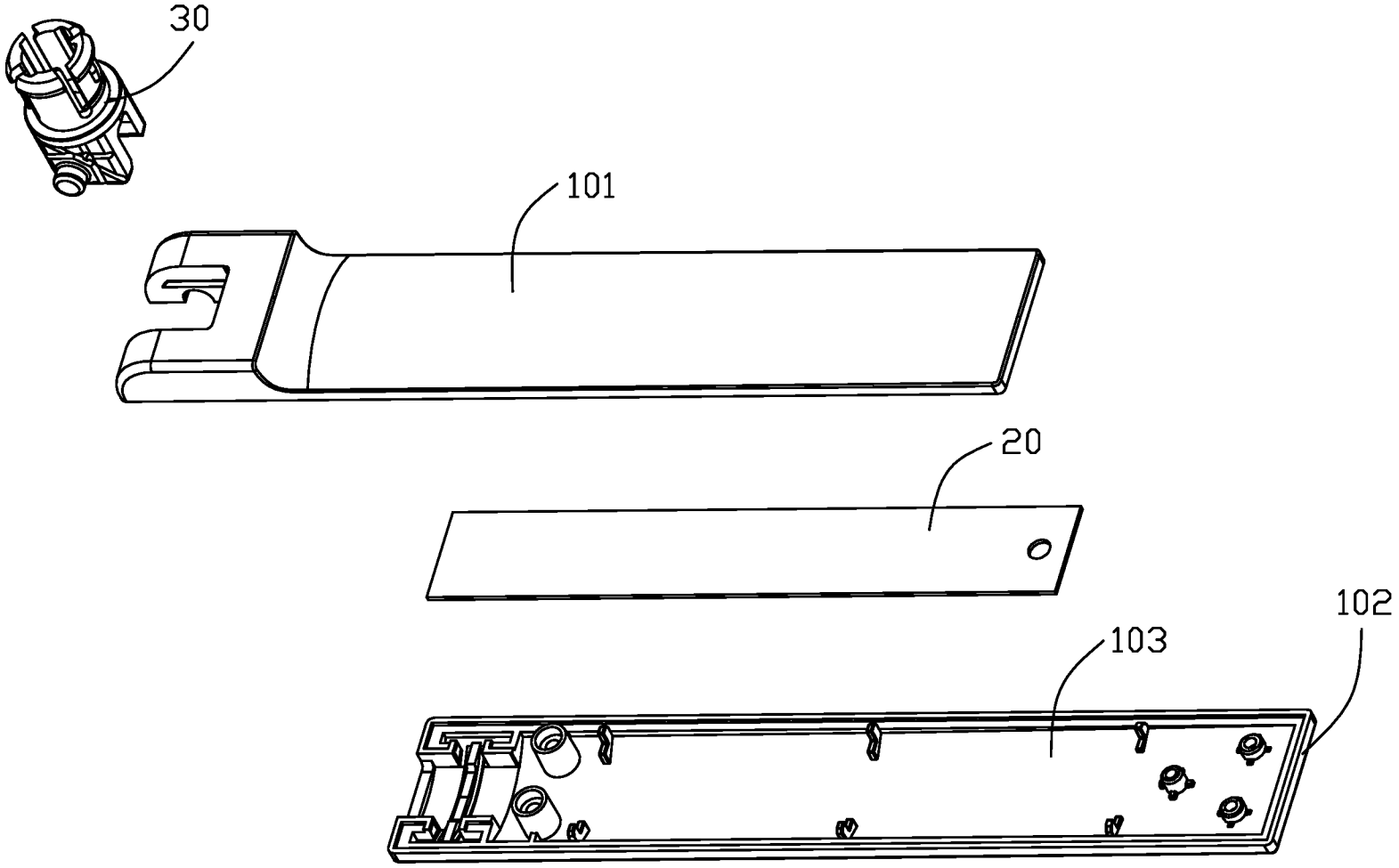
FIG. 2 is an exploded view of the antenna module.
Figure 3:
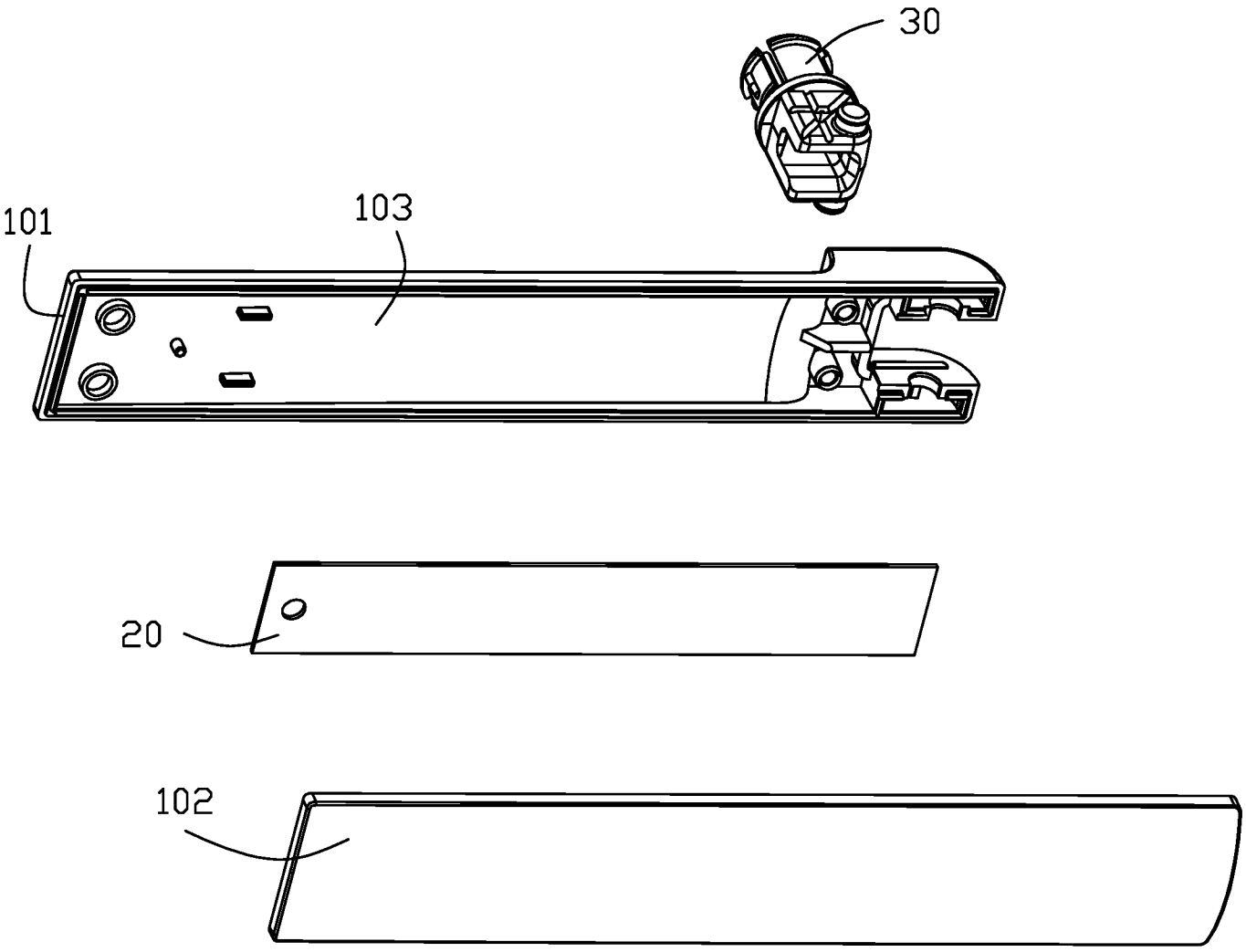
FIG. 3 is a view similar to FIG. 2 but from another perspective.

Referring to FIGS. 1-4, an antenna module 100 includes a columnar outer case 10, an elongate substrate 20 received in the case 10, a connector part 30 mounted at one end of the case 10, and a coaxial cable (not shown) mounted and connected in a generally known manner.

The case 10 has an upper case part 101 and a lower case part 102 together defining a receiving chamber 103 for accommodating the substrate 20.

Figure 4:
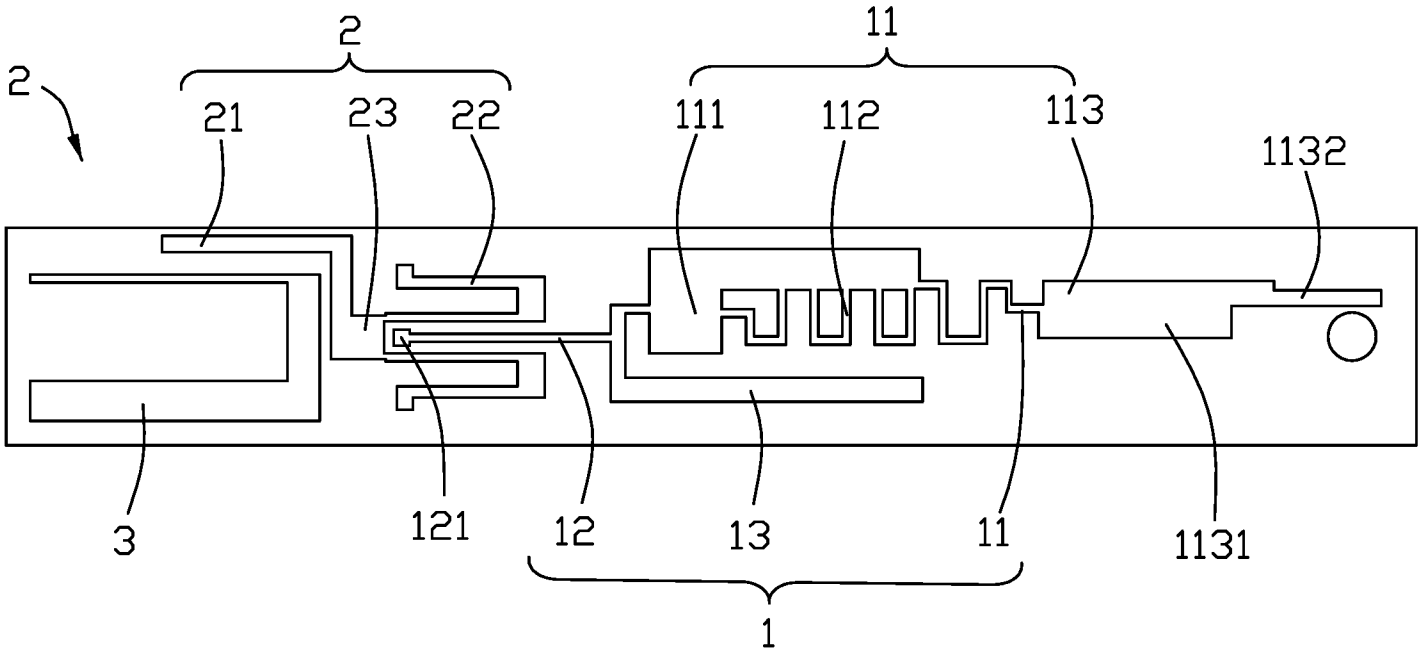
FIG. 4 shows a substrate of the antenna module and conductive pieces thereon.

As shown in FIG. 4, on the substrate 20 are disposed a first conductive piece 1, a second conductive piece 2, and a third conductive piece 3 separated from one another. The first conductive piece 1 includes a main part 11, a straight part 12 extending from one end of the main part 11 along a lengthwise direction of the elongate substrate 20, and a bent part 13 extending from and located at a lateral side of the main part 11. A free end of the straight part 12 defines a feeding point 121. The bent part 13 is L-shaped, i.e., angled 90 degrees. The main part 11 is adapted for controlling a current resonant path in a 5 GHz frequency band while the bent part 13 is adapted for controlling a current resonant path in a 2.4 GHz frequency band. The main part 11 includes a connecting portion 111 connected to the straight part 12, a meander portion 112 connected at one end thereof to the connecting portion 111, and an end portion 113 connected to an opposite end of the meander portion 112. The end portion 113 includes a first section 1131 connected to the meander portion 112 and a second section 1132 continuing the first section 1131. A width of the first section 1131 is greater than a width of the second section 1132. The meander portion 112 has consecutive alternate U-shaped portions for current flow in the 5 GHz frequency band. In the present embodiment, the straight part 12 and the connecting portion 111 constitute transmission line for quarter-wavelength at 5 GHz frequency, the meander portion 112 converts current phase for half-wavelength at 5 GHz frequency, and the end portion 113 flows current for half-wavelength at 5 GHz frequency.

The second conductive piece 2 including a bent portion 21, two U-shaped portions 22, and a ground portion 23 connected between the bent portion 21 and the two U-shaped portions 22. The U-shaped portion 22 has two 90 degree bends. The two U-shaped portions 22 of the second conductive piece 2 are arranged in mirror image symmetry relative to the straight part 12 of the first conductive piece 1. A space is formed between the U-shaped portions 22 and the ground portion 23 and the straight part 12 of the first conductive piece 1 is disposed in the space. The U-shaped portions 22 are adapted for controlling a current resonant path in a 5 GHz frequency band while the bent portion 21 is adapted for controlling a current resonant path in a 2.4 GHz frequency band.

The third conductive piece 3 is substantially U-shaped. The bent portion 21 of the second conductive piece 2 is L-shaped with 90 degrees bend and is disposed beside the third conductive piece 3. The third conductive piece 3 is located near the connector part 30.

Figure 5:
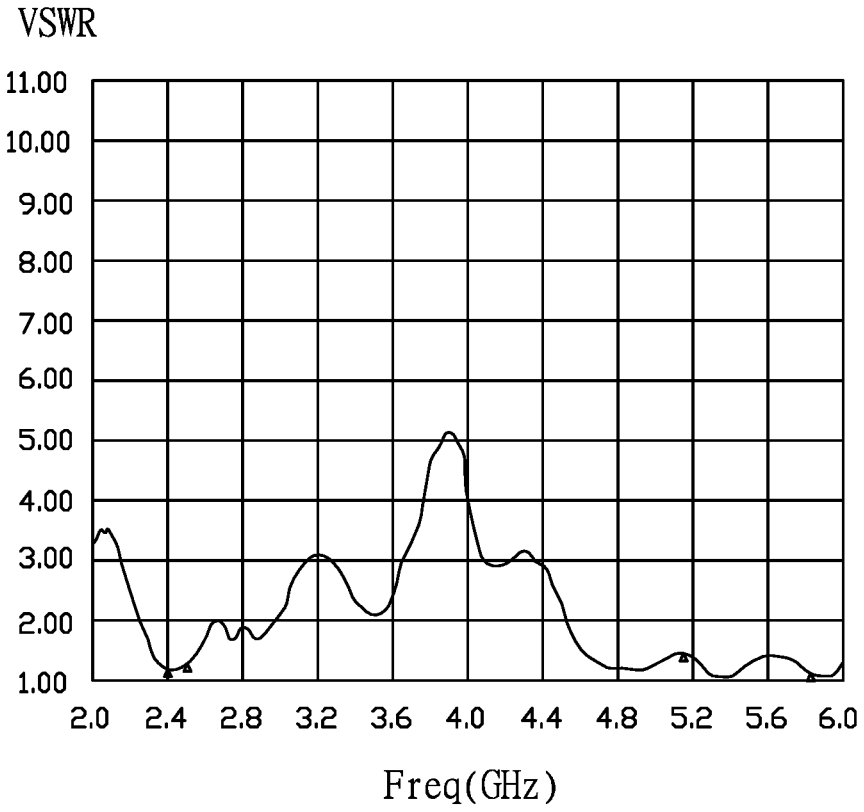
FIG. 5 depicts a plot of Voltage Standing Wave Ratio (VSWR) versus frequency for the antenna module.

The antenna module 100 is operable essentially as a dual band dipole in 2.4 GHz and 5 GHz frequency bands, wherein antenna gain is greater than 2.84 dBi in 2.4 to 2.5 GHz frequency band and greater than 3.83 dBi in 5.15 to 5.85 GHz frequency band, as shown in Table 1 which is an antenna characteristics table. In Table 1, it can be seen that antenna gain increases at high frequency band. With reference to FIG. 5, it can be seen that, in 2.4 to 2.5 GHz frequency band and in 5.15 to 5.85 GHz frequency band, VSWR<2.

TABLE 1

| | Efficiency | | |
|---|---|---|---|
| Frequency (MHz) | Efficiency (%) | Average Gain (dB) | Peak Gain (dBi) |
| 2400 | 74.80 | −1.26 | 2.93 |
| 2450 | 74.02 | −1.31 | 2.88 |
| 2500 | 75.95 | −1.19 | 2.84 |
| 5150 | 76.82 | −1.15 | 4.25 |
| 5350 | 74.28 | −1.29 | 4.01 |
| 5470 | 70.81 | −1.50 | 3.83 |
| 5600 | 69.09 | −1.61 | 4.08 |
| 5750 | 72.00 | −1.43 | 4.36 |
| 5850 | 71.42 | −1.46 | 4.26 |

To obtain a dipole antenna of high gain, the first conductive piece 1 has the main part 11, the straight part 12, and the bent part 13 while the second conductive piece 2 has the bent portion 21 and the two U-shaped portions 22, wherein the main part 11 and the two U-shaped portions 22 control current path in 5 GHz frequency band while the bent part 13 and the bent portion 21 control current path in 2.4 GHz frequency band.

What is claimed is:

1. A dipole antenna comprising:

an elongate substrate;

a first conductive piece on the substrate, the first conductive piece including a main part, a straight part extending from one end of the main part along a lengthwise direction of the elongate substrate, and a bent part extending from and located at a lateral side of the main part, a free end of the straight part defining a feeding point, the main part being adapted for controlling a current resonant path in a 5 GHz frequency band while the bent part being adapted for controlling a current resonant path in a 2.4 GHz frequency band;

a second conductive piece on the substrate and separated from the first conductive piece, the second conductive piece including a bent portion, two U-shaped portions, and a ground portion connected between the bent portion and the two U-shaped portions; and a third conductive piece on the substrate and separated from the first conductive piece and the second conductive piece; wherein the main part of the first conductive piece includes a connecting portion connected to the straight part, a meander portion connected at one end thereof to the connecting portion, and an end portion connected to an opposite end of the meander portion; and the straight part of the first conductive piece is disposed between the two U-shaped portions of the second conductive piece.

2. The dipole antenna as claimed in claim 1, wherein the end portion of the main part of the first conductive piece includes a first section connected to the meander portion and a second section continuing the first section, a width of the first section being greater than a width of the second section.

3. The dipole antenna as claimed in claim 1, wherein the two U-shaped portions of the second conductive piece are arranged in mirror image symmetry relative to the straight part of the first conductive piece.

4. The dipole antenna as claimed in claim 1, wherein the third conductive piece is disposed beside a portion of the second conductive piece and is substantially U-shaped.

* * * * *